United States Patent [19]

Campagna et al.

[11] 4,070,148

[45] Jan. 24, 1978

[54] APPARATUS FOR MONITORING PRODUCT TEMPERATURE IN AN OPEN ENDED, SECONDARY EMISSION, PRODUCT CARRYING CONVEYOR FURNACE

[75] Inventors: Frank John Campagna, Hopewell Junction; Gary Frank Pavlovic, Beacon, both of N.Y.

[73] Assignee: International Business Machines Corporation, Armonk, N.Y.

[21] Appl. No.: 695,604

[22] Filed: June 14, 1976

[51] Int. Cl.[2] ..... F27D 19/00

[52] U.S. Cl. ..... 432/50; 73/340

[58] Field of Search ..... 432/50; 73/340; 236/15 BF

[56] References Cited

U.S. PATENT DOCUMENTS

| | | | |
|---|---|---|---|
| 1,230,035 | 6/1917 | Royston | 73/340 |
| 2,646,681 | 7/1953 | Walton | 236/15 BF |
| 2,712,241 | 7/1955 | Stokes | 73/340 X |
| 3,247,364 | 4/1966 | Waziri | 73/340 |
| 3,582,054 | 6/1971 | Beck | 432/50 |
| 3,806,309 | 4/1974 | Laws et al. | 432/50 |

*Primary Examiner*—John J. Camby

*Attorney, Agent, or Firm*—Edward W. Brown; William J. Dick

[57] ABSTRACT

Apparatus for monitoring the product temperature in an open ended furnace of the secondary emission type, the furnace having a plurality of serially arranged heating zones therein and including a conveyor which passes through the muffle of the furnace for carrying product thereon through the furnace. The furnace includes apparatus for adjusting the temperature in each of the zones. At least one cable passes through the furnace superimposed of the conveyor and carries thereon a plurality of temperature sensors which are serially arranged along the cable. The sensors are connected externally of the furnace to provide external monitoring of the temperatures in at least preselected zones (critical zones) of the furnace while the cable is provided with sag inhibiting apparatus to keep tension on the cable when the furnace is in operation.

6 Claims, 4 Drawing Figures

APPARATUS FOR MONITORING PRODUCT TEMPERATURE IN AN OPEN ENDED, SECONDARY EMISSION, PRODUCT CARRYING CONVEYOR FURNACE

SUMMARY OF THE INVENTION AND STATE OF THE PRIOR ART

The present invention relates to apparatus for monitoring product temperature in a furnace, and more particularly relates to apparatus for monitoring product temperature in an open ended furnace of the secondary emission type; the furnace having a plurality of serially arranged heating zones therein and a conveyor which passes therethrough for carrying product thereon through the furnace; the apparatus being located to permit adjustment of the temperature in the various zones of the furnace.

In the manufacture of gas panels (gaseous discharge display panels) there are numerous process steps which are deemed critical to the final acceptable operation of the panel. Typically in the manufacture of AC type panels, a pair of glass plates are processed first by putting a layer of chromium-copper-chromium on one major surface of each of the plates, and then by suitable photo-resist techniques well known in the semiconductor art, the metal is etched to form conductive lines on the plates, the lines on one of the plates being orthogonal to the lines on the other of the plates when they are mated together. After suitable cleaning operations, the surface of the plates are covered with a passivating layer, for example a glass frit, which is then allowed to be reflowed in a furnace, and which is followed by the laying down of a layer of magnesium oxide. Spacer rods are then placed on the bottom plate along with outboard seal rods along the periphery of the bottom plate, the plates are placed together and then passed through a seal furnace. The seal rods have a lower melting temperature than the smaller diameter spacer rods so that upon the product in the furnace reaching a suitable temperature the sealing rods melt allowing the upper plate to drop down onto the spacer rods thereby forming a pocket or cavity between the two plates which are now sealed around their periphery. The sealing temperature of the rods is critical and must be controlled within very narrow limits. For example, the window for the seal of the type utilized in U.S. Patent application, Ser. No. 572,036, filed on Apr. 28, 1975, now U.S. Pat. No. 3,982,918 should be between 478° to 492° C. If the seal rod does not attain at least 478° C an improper seal will be made, while if the temperature exceeds 492° C crazing of the passivating layers will occur. Accordingly, it is imperative that the temperature of the furnace in which the sealing occurs be very accurately controlled.

After a proper cooling off period, the panel is placed in another furnace, a vacuum drawn on a nipple attached to the rear panel, and the panel is permitted to bake under controlled conditions to effect outgassing thereof. The cavity is then filled with a neon-argon mixture and a resistance type heater element around the nipple effects seal off.

Conventionally open ended furnaces having separate heating zones and in which a conveyor passes through for carrying product has permitted of temperature control of the various zones in the furnace and has permitted of temperature monitoring (of a sorts) of the temperature of the muffle by placing temperature sensors externally of the muffle but interiorly of the furnace casing. However, with product in which the temperature must be controlled within very narrow limits, it is mandatory that the furnace be profiled very accurately to prevent exceeding both an upper and lower limit such as outlined above with respect to the manufacture of gas panels. In practice, and heretofore, this was accomplished by placing dummy product on the conveyor, permitting the conveyor to carry the dummy product with a thermocouple or the like attached through the furnace and monitoring at intervals the temperature of the product as it passed through the furnace. Adjustments then were made to each of the required zones and then another dummy product was run through the furnace again with a thermocouple attached and further adjustments were made. In many instances the procedure would require four to five days and sometimes even as long as two weeks to properly profile the furnace so that the product would reach the required "window" of temperature within the furnace. The problem of precise zone control is aggravated when the furnace is located within a room which contains facilities for maintaining a clean atmosphere (e.g., Class 100 or better). Constant air circulation entering the open ends of the furnace obviously create drafts which effect the temperature of at least some of the zones.

With the apparatus of the present invention, existing open ended furnaces of the secondary emission type having a plurality of serially arranged heating zones may be brought to their proper operating temperature precisely within a matter of hours as opposed to days, and may be maintained in a clean atmosphere without over reactions in temperature gradients due to drafts.

In view of the above, it is a principle object of the present invention to provide a simple but effective modification of existing open ended, secondary emission type heating furnaces having serially arranged heating zones therein and wherein the furnace includes a conveyor which passes therethrough for carrying product thereon, so that the temperature of the heating zones may be correctly brought to their proper operating temperatures within very short periods of time.

Yet another object of the present invention is to provide a simple yet effective modification for existing furnaces of the type described which permits of easy change of temperature sensors within the muffle of the furnace without shutting down the furnace.

Still another object of the present invention is to provide temperature monitoring within the muffle of an open ended furnace which permits of precise zone temperature control even with the furnace in a clean atmosphere.

Other objects and a more complete understanding of the invention may be had by referring to the following specification and claims taken in conjunction with the accompanying drawings in which:

Figure 1:
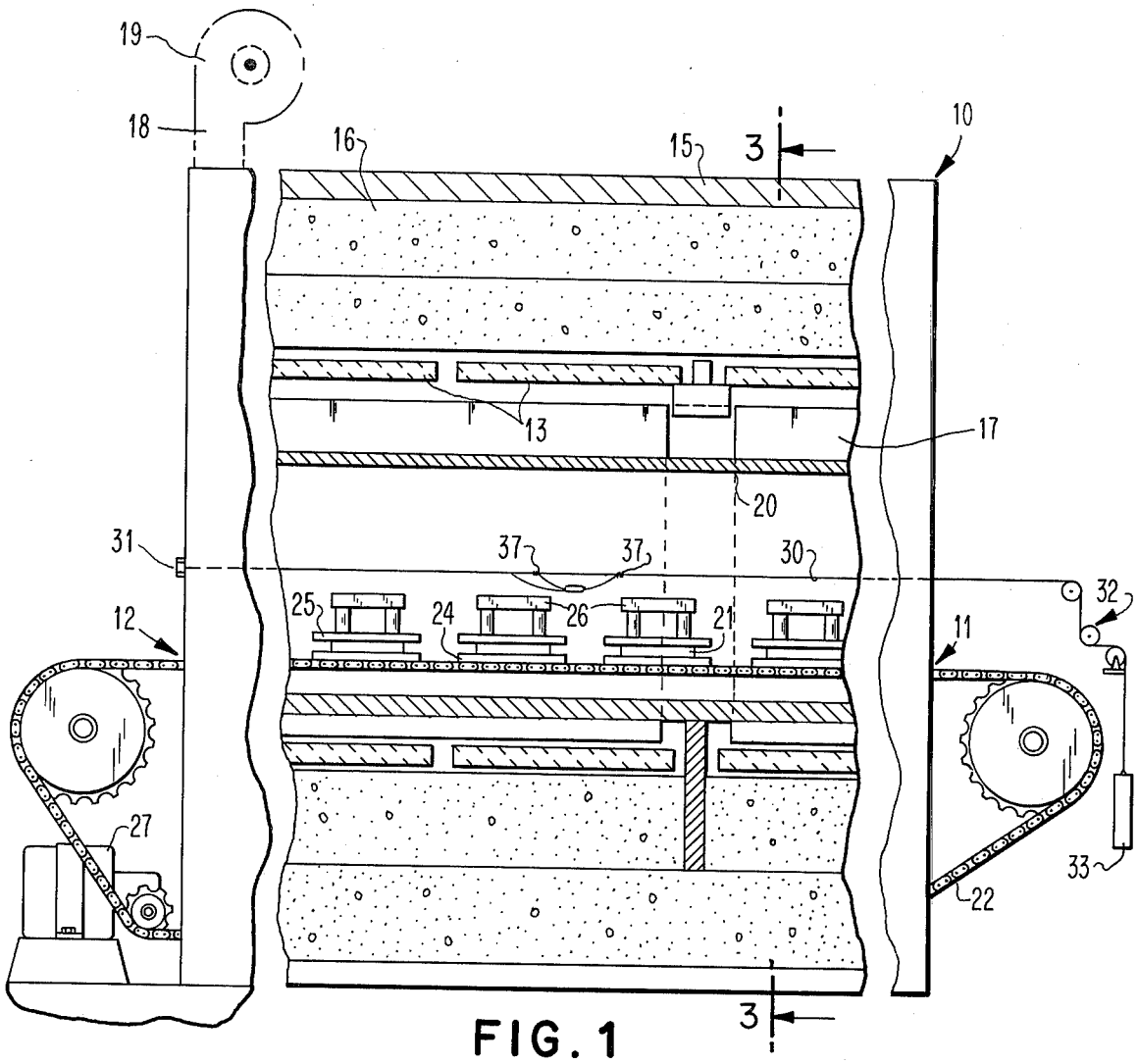
FIG. 1 is a fragmentary side elevation view of a typical furnace incorporating the apparatus of the present invention.

Turning now to the drawings, and especially FIG. 1 thereof, a typical 14 zone furnace 10 such as manufactured by B.T.U. or Watkins-Johnson is illustrated therein. As shown, the furnace has an open inlet end 11 and outlet end 12 and contains a plurality of serially arranged heating zones therein, there being separate heater elements 13 in each zone so as to make the temperature in each zone adjustable even though adjacent zones are in communication with each other. As illustrated best in the cross section shown in FIG. 3, the furnace contains an outer casing 15, adjacent insulating fire brick 16 which form a cavity 17 in the central portion of the casing. Heater elements 13 may also be mounted in the exhaust plenums 18 of blowers 19, the exhaust plenums 18, illustrated in FIG. 1, being connected to the cavity 17 associated with a particular zone. Mounted interiorly of the cavity 17 and extending longitudinally of the furnace is a conventional muffle 20 which receives heat from the heaters (in the illustrated instance electrical heaters) and which heats the product 21 carried on a conveyor, in the illustrated instance, a pair of conveyors 22 and 23 respectively. In the illustrated instance, the panels 21 are located intermediate a platen 24 and a flat cover plate 25 on which a weight 26 is mounted to aid in the sealing process described heretofore.

As shown best in FIG. 1, the conveyors 22 and 23 pass through the furnace 10 to permit loading of product 21 at one end and unloading of product from the other end. The conveyor, as illustrated, has drive means 27 which permit adjustment of the speed of the conveyor so as to permit adjustment of resident time of product in the furnace. Additionally, and as is conventional on furnaces of this type, a control panel 28 includes separate controls for each of the zones, for example, when the furnace is heated electrically (as shown), the furnace controls may be comprised of rheostats.

In accordance with the invention, means are provided for passing a temperature sensor holder through the muffle 20 of the furnace and retaining the temperature sensors in a position superimposed of the product as it passes through the muffle. To this end, and as shown best in FIGS. 1, 3 and 4, the temperature sensor holder comprises a cable 30, in the present instance, fastened at one end to the muffle as at 31 by any convenient means, for example, a hook eye, with the opposite end of the cable passing over a pulley system 32 and connected to a weight 33, the weight serving to maintain tension on the cable and inhibiting sag therein despite the heat of the furnace. Typically the cable may be comprised of a 0.032 inch diameter stainless steel. The temperature sensors, while capable of multiple form, may comprise thermocouples such as the type K thermocouples made by Omega Engineering Corporation in Stamford, Connecticut. Preferably, the thermocouple is mounted in a two-bore tube composed of quartz, the first bore 34 permits the passage of stainless steel wire 35 which is wire wrapped around the stainless cable 30, and the second bore 36 containing a thermocouple such as heretofore described. The wire lead 37 emanating from the thermocouple (wire pair) may be loosely wrapped around the cable and extend to one end 11 or the othe end 12 of the furnace where it is coupled to a small signal amplifier means 38 which may be connected in a conventional manner to a chart recorder, analog readout, etc. The amplifier 38 may be a Rosemount Temperature Transmitter, a Leeds and Northrup amplifier or transmitter, either of which sends an analog signal to either a recorder, or direct reading instrument as above described or to a digital readout system or display to indicate temperature in a particular zone directly.

Figure 3:
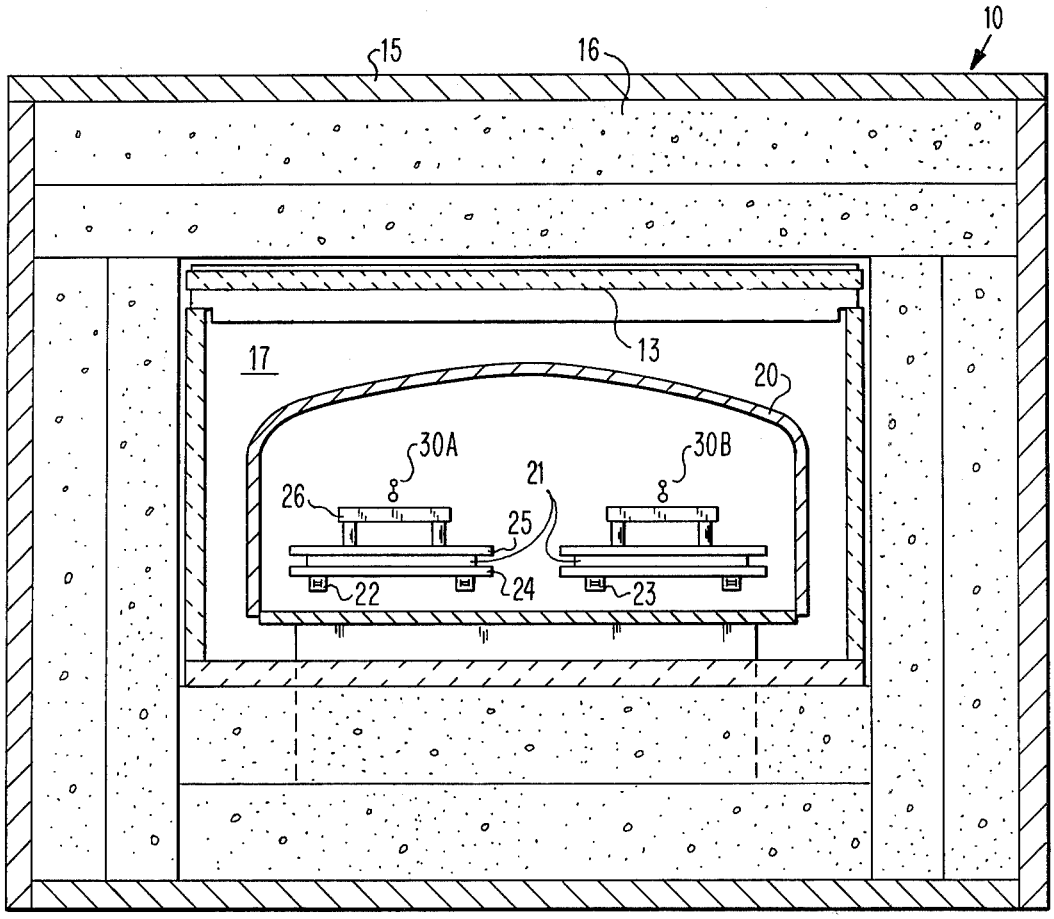
FIG. 3 is an enlarged sectional view taken along line 3—3 of FIG. 1.
Figure 4:
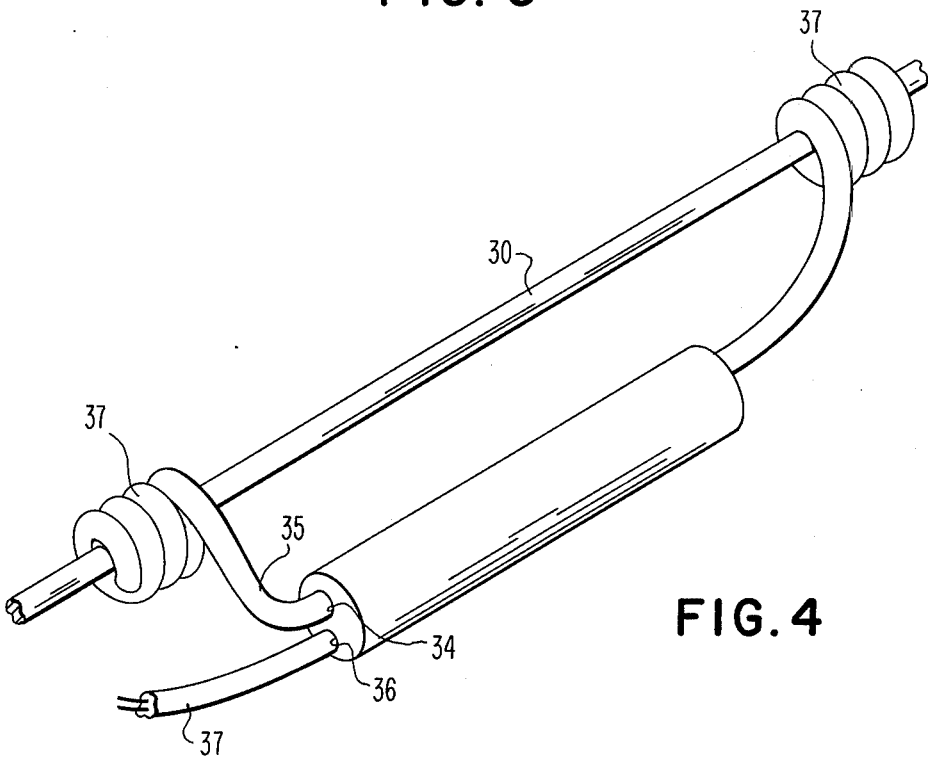
FIG. 4 is an enlarged fragmentary perspective view of a typical temperature sensor for use in the present invention.

The temperature sensors may be located in any desired position, for example, in FIG. 3, two cables 30A and 30B are illustrated, one directly over each of the conveyors, and additional temperature sensor holding means or cables may be provided at other locations to give a cross sectional temperature gradient within the muffle along any desired plane.

Figure 2:
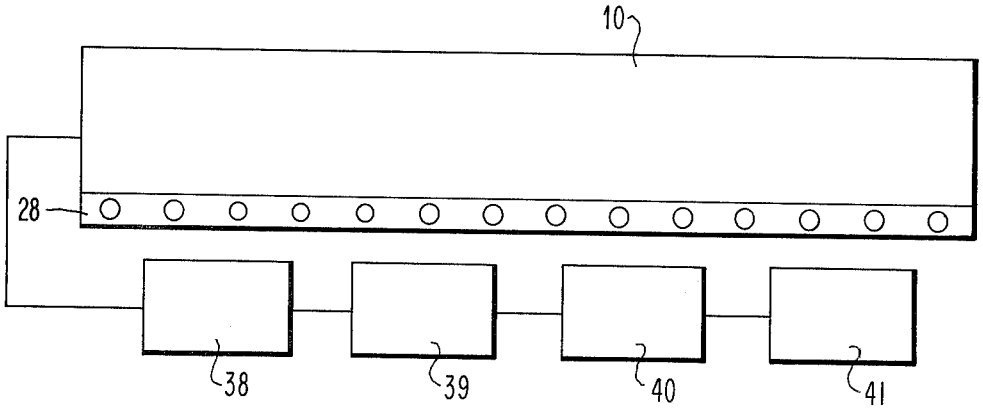
FIG. 2 is a schematic diagram of a typical set-up for monitoring the temperatures in the various zones of the furnace.

While the various controls for the heater elements may be controlled manually to give the proper operating temperature within the muffle so as to determine accurately the temperature of the product 21 as it passes through the muffle on the conveyor, the monitoring means 38 may be directly connected to a distributive interface such as disclosed in U.S. Patent application, Ser. No. 673,011, filed on Apr. 2, 1976, the pertinent parts of which are herein incorporated by reference. In turn, the distributive interface 39 (FIG. 2) may be connected to a computer 40 such as an IBM System 7 which compares through suitable programming the temperatures actually received from the temperature control monitor in the various zones of the furnace with an ideal temperature profile for the furnace. Any differences in the actual reading verses that which it should be may suitably be displaced on a graphic terminal 41 such as a Tektronix Model No. 4015. If the temperature of one or more zones is out of the desired range then the operator may make suitable adjustments as through the control rheostat 28. Additionally, if the temperature sensors indicate that a particular critical zone has overheated, to save product within the furnace, the conveyor speed may be adjusted by the operator to limit the resident time of the product within the furnace.

The insertion or removal of the cable 30 with associated sensors is relatively simple even with the furnace in operation. A fixture is placed on the conveyor and the cable is attached, the fixture of course having a height sufficient to prevent the cable from touching the product.

Thus the apparatus of the present invention permits of the simple modifications of a furnace to monitor the temperature in the various zones so that the product, in the particular instance a gas panel, may be processed in accordance with the known and desired parameters. The cable which is used as the temperature sensor holder of course may be replaced with rods, and of course may be tensioned in many various ways such as by drums which will permit paying in and out of the cable so that the sensors may be more easily removed from the furnace for change or repair.

Although the invention has been described with a certain degree of particularity, it is understood that the present disclosure has been made only by way of example and that numerous changes in the details of construction and the combination and arrangement of parts and the mode of operation may be made without departing from the spirit and the scope of the invention as hereinafter claimed.

What is claimed is:

1. In an open ended furnace of the secondary emission type having a plurality of serially arranged heating zones therein, said furnace including a conveyor passing therethrough for carrying product therein through said furnace and means for adjusting the temperature in said zones; the improvement comprising: apparatus for monitoring product temperature within said furnace; said apparatus comprising at least one temperature sensor holder passing through said furnace, superimposed of said conveyor; a plurality of temperature sensing means on said holder and serially arranged therealong, means connecting each of said temperature sensing means externally of said furnace to provide external monitoring thereof.

2. In an open ended furnace in accordance with claim 1 wherein said temperature sensor holder comprises a cable.

3. In an open ended furnace in accordance with claim 2 including means to tension said cable to inhibit sag therein when said furnace is in operation.

4. In an open ended furnace in accordance with claim 1 wherein said temperature sensing means comprise thermocouples.

5. In an open ended furnace in accordance with claim 4 wherein said thermocouples are mounted within a quartz tube and depend from said cable.

6. In an open ended furnace in accordance with claim 1 including display means for displaying graphically the temperature profile of said furnace.

* * * * *